United States Patent [19]

Clark, III

[11] Patent Number: 4,601,224

[45] Date of Patent: Jul. 22, 1986

[54] HOT WIRE CUTTING SYSTEM

[76] Inventor: William T. Clark, III, No. 6 Davis Blvd., New Orleans, La. 70121

[21] Appl. No.: 658,435

[22] Filed: Oct. 5, 1984

[51] Int. Cl.[4] ..... B26D 7/10

[52] U.S. Cl. ..... 83/74; 83/171; 83/521; 83/522; 83/651.1

[58] Field of Search ..... 83/13, 171, 521, 522, 83/651.1, 701, 914, 370, 372, 74

[56] References Cited

U.S. PATENT DOCUMENTS

| | | | |
|---|---|---|---|
| 3,017,487 | 1/1962 | Priestly | 83/171 |
| 4,222,299 | 9/1980 | Treffner et al. | 83/171 X |
| 4,391,168 | 7/1983 | Gerber et al. | 83/13 X |

*Primary Examiner*—James M. Meister

*Assistant Examiner*—John L. Knoble

*Attorney, Agent, or Firm*—Nies, Webner, Kurz & Bergert

[57] ABSTRACT

A hot wire cutting system for cutting a pattern shape in a block of polyfoam for use as a casting mold for a metal shielding block to be used in radiotherapy treatments is described. The system provides proportioned current responsive to deflection of the hot cutter wire in order to cancel the deflection and maintain the wire in its optimal central cutting position. The hot cutter-wire preferably passes through a field which provides fine vibratory motion of the cutting wire allowing use of lower wire temperatures to effect the cutting. The system may include optical means for determining the accuracy of the profile cut in the polyfoam block.

9 Claims, 9 Drawing Figures

HOT WIRE CUTTING SYSTEM

BACKGROUND OF THE INVENTION

It is conventional practice in radiation therapy to cast beam-forming shielding blocks specifically individualized to each patient. The shielding blocks are usually cast in a polyfoam block such as polystyrene which has been especially cut to make the mold. One method of making the shielding block molds is to place the patient X-ray a set distance from a pivot which simulates the radiation source and to place a block of rigid polyfoam a set distance between the X-ray and the pivot and to cut the polyfoam with a cutter which follows either a pivoted rigid rod or long wire cable as the operator traces the designated treatment areas on the X-ray.

The voids thus created in the polyfoam are then filled with a molten eutectic alloy which cools to become one or more shielding blocks. The shielding blocks are then placed on a treatment tray in the beam of the radiation therapy machine, such as an accelerator or cobalt unit. The shielding blocks are manipulated into position on the treatment tray to shield the areas of the patient which are to be protected from radiation.

While this current practice of defining the radiation beam is certainly better than the older practice of manually stacking and arranging lead blocks, the whole process leaves much to be desired, and it leads to many cumulative inaccuracies because the process described above cannot produce shields with sufficient accuracy for use with modern high-powered, well-collimated treatment machines. Even slight errors in block fabrication can seriously undermine the physician's intent by allowing some areas to go untreated while others are seriously over-exposed.

In the prior-art hot-wire block cutters, exemplified by U.S. Pat. Nos. 3,968,711, Wilson, 3,017,487, Priestly, and 3,540,336, Kelsey, the wire is electrically heated to some pre-selected "optimum" in order to cut the polyfoam. However, such a cutter cannot cut accurately, because the wire temperatures cannot be correct for all cutting speeds and depths of cut. Not only does the thickness change because of the changing angle, but the speed constantly changes as the operator traverses the complex pattern. Accurate cutting of complex detailed shapes is not possible, because the cutter either drags behind the operator or takes the path of least resistance, unable to keep pace with the constantly varying load placed upon it. Accordingly, it is the purpose of this invention to provide an improved system of producing and verifying, extremely accurately formed shielding blocks.

DESCRIPTION OF THE INVENTION

The improved hot-wire cutter of this invention eliminates the difficulties associated with conventional hot-wire cutters, because it automatically detects even minute deflections of the wire and instantly proportions the wire temperature to cancel the deflection. It is essential that the current be precisely proportioned to the wire in response to demand in order to eliminate errors caused by inappropriate amounts of heat. Therefore, simple switching of current to the wire even in response to deflection offers no remedy because the wire overshoots, cuts an over-large line, makes a distorted pattern and leaves artifacts in the polyfoam. In the apparatus of this invention, the greater the deflection of the hot-wire cutter, the greater the amount of current directed to the hot-wire to cancel the deflection. Response of the system is immediate, and progress of the cutting is unimpeded. Using this system, output is increased threefold over use of the prior art apparatus due to its greater accuracy and efficiency.

Figure 1:
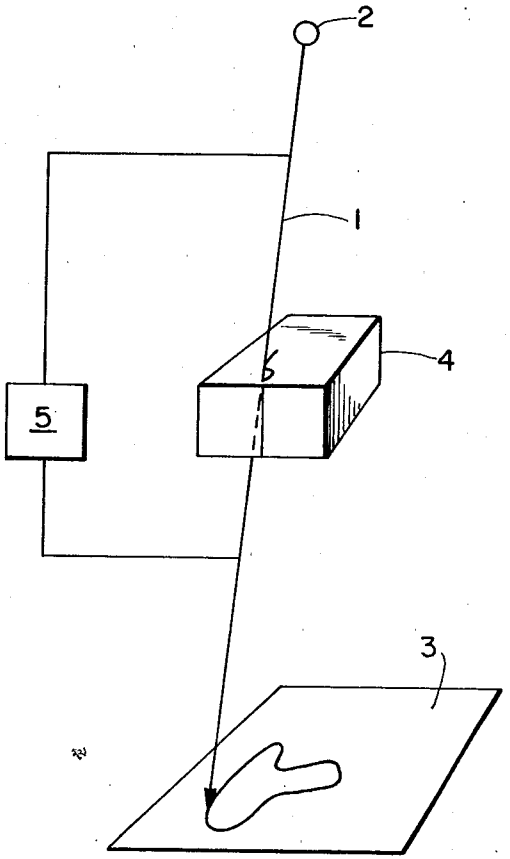
(PRIOR ART) FIG. 1
FIG. 1 shows a diagram of a block cutter of the prior-art.

The conventional hot-wire cutter of the prior art is shown schematically in FIG. 1 and described in detail in Wilson, U.S. Pat. No. 3,968,711. Schematically , a hot wire 1 (or segmented rod or cable with a hot wire in the segment) communicates with a pivot 2 at its upper end, and an exposed X-ray film 3 at its lower end. As the operator traces along the X-ray film 3, the polyfoam block 4 is cut by the hot wire 1 heated by a source of current 5. Another known type of hot wire cutter is shown in the Priestly U.S. Pat. Nos. 3,017,487 and Re. 25,016 where a foam plastic block is maneuvered against a taut heating conductor wire. The wire, when at rest is centered in an aperture through a conductor. When the block is moved it deflects the wire against the conductor so as to close an electric circuit to heat the wire.

Figure 2:
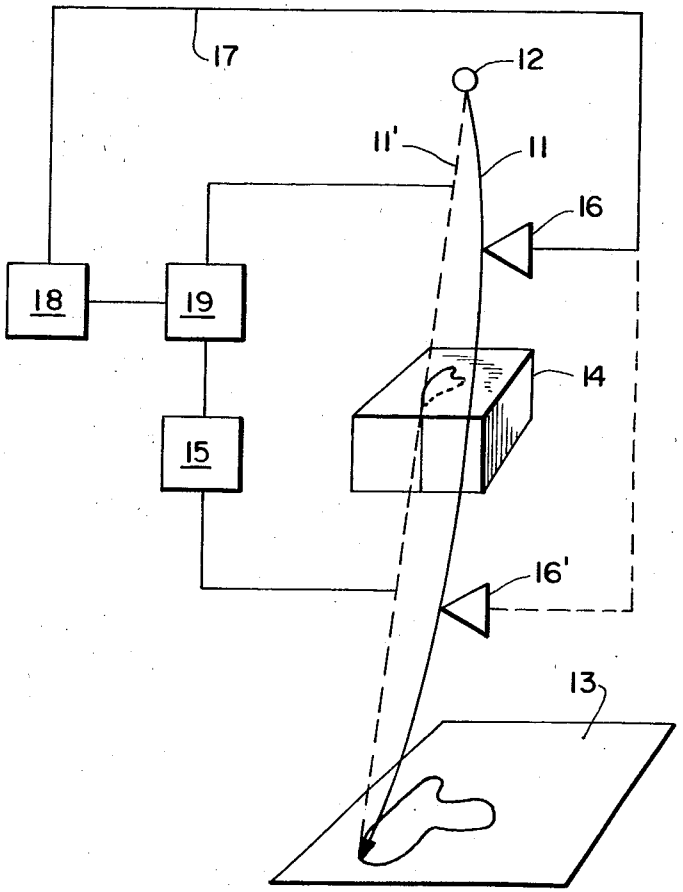
FIG. 2 shows a diagram of a block cutter of the present invention.

An improved hot-wire cutter of the invention is shown schematically in FIG. 2. Here the deflected hot wire 11 is shown moving along the X-ray film 13 and cutting the polyfoam block 14. As the hot wire 11 is deflected (not drawn to scale) from the straight line 11' from the pivot 12 to the X-ray film 13, the deflection is detected by a sensor 16 or 16' which may be placed anywhere along the length of the hot-wire cutter which is liable to deflection, either above or below foam block 14. The error signal developed from sensor 16 or 16' follows a feedback path 17 to an integration or logic circuit 18 which processes the signal for application to an electrical gating device 19 which proportions an increase in the electrical current applied to the cutter wire 10 from the current source 15, the effect of the proportionally increased current being to soften the block material and reduce or eliminate the wire deflection and thereby cancel the signal received and permit the wire to return to its original central position. The pivot position represents the position of the radiation source in the radiation therapy machine. Such a system is capable of extremely accurate cutting, enabling radiation therapy to be refined to a high order. The wire may be a steel wire, or of other suitable material.

Many circuit schemes are suitable for use with this invention, and they may be digital or analog. In the digital mode of operation, the developed error signal is a train of pulses, the duration and frequency of which vary according to the degree of deflection, and which are integrated to provide an analog signal which proportions current to the cutting wire through the gating device after signal processing. In analog operation, the error signal is a current which varies according to the degree of deflection, and this signal is likewise processed and applied to the gating device in order to provide proportional control of the cutting wire. In both cases the signal processing serves to define the characteristic curve of the current proportioned to the cutting wire when the wire deflects, and the curve may be adjusted as necessary to accommodate the thermal characteristics of the wire. It will be readily understood by one skilled in the art that where the apparatus is described in terms of certain electric operations the same functions can be performed by electronic equipment, microprocessors, etc. without departing from the scope of the invention.

Figure 3:
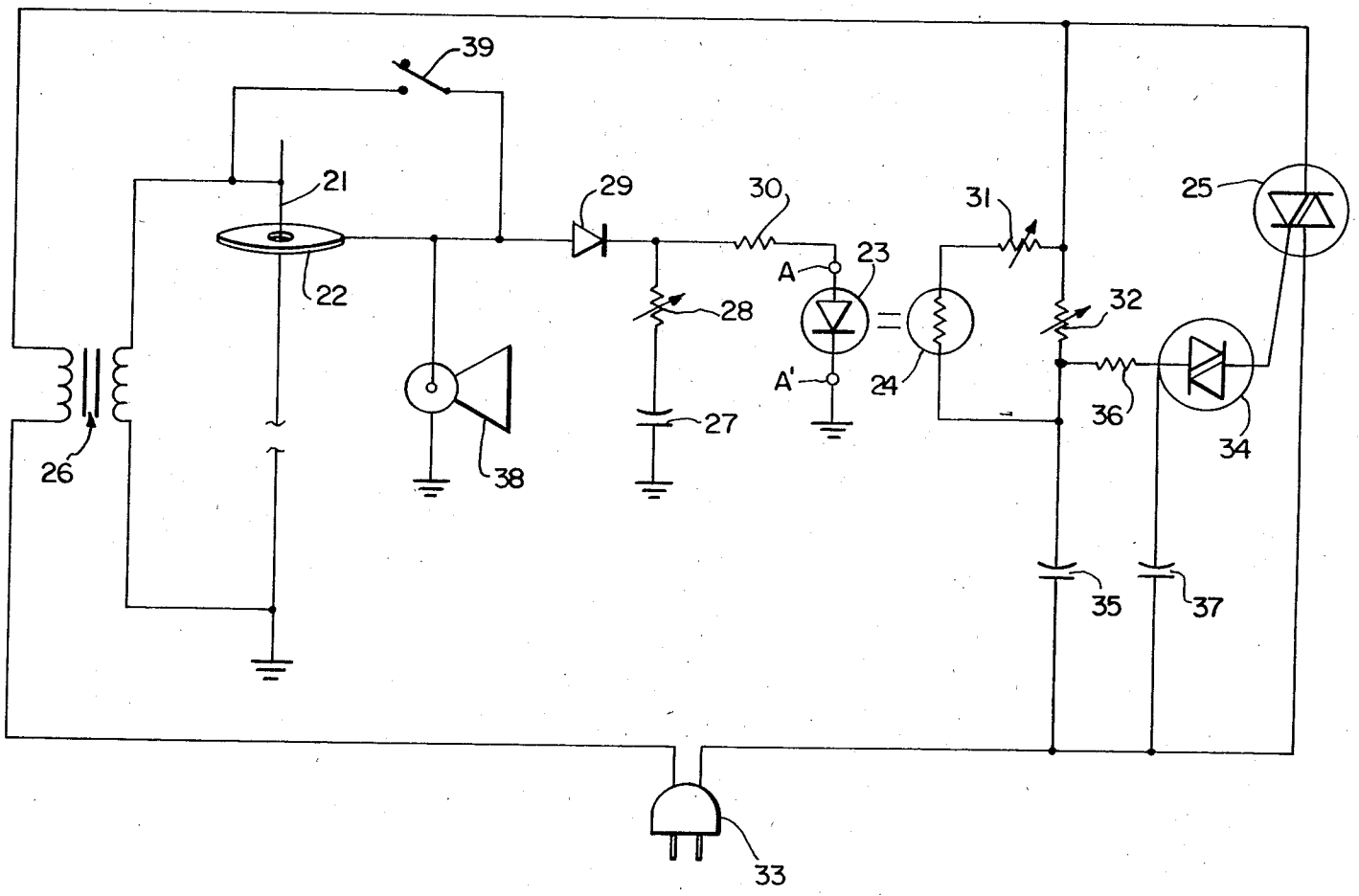
FIG. 3 shows a pulse-digital circuit of the present invention.

A very effective pulse-digital circuit is shown at FIG. 3. Here the hot wire 21 (or hereafter understood to mean any part of the cutter from the pivot to the X-ray which is liable to deflect) is shown surrounded by a conductive annulus 22 which is a deflection sensor. When the wire 21 deflects, it causes the light emitting diode 23 to illuminate the photoconductor 24, which in turn fires the triac 25 which increases the current to the transformer 26 which feeds current to the heated wire 21. The temperature of the wire 21 is thus raised, the deflection is corrected, the triac 25 cuts off, and the current returns to normal until the cycle repeats as needed. The deflection or error signal is processed through an integration circuit, such as capacitor 27 and potentiometer 28, which accumulates rapid or long pulses (anticipating large demand) and sustains elevated current flow at an increased average intermediate level. The diode 29 prevents discharge of the accumulated pulses except through potentiometer 28 and current limiter resistor 30 onto light emitting diode 23. Potentiometer 31 controls the sensitivity of the sensing circuit and the degree to which the circuit will cause the current to be increased. Potentiometer 32 controls a baseline or bias current which may be applied to transformer 26 fed by current source 33 through triac 25 by controlling the trigger diac 34 through firing network capacitors 35, resistor 36, and capacitor 37. The time constant of this firing network may also be used to integrate the error signal caused by deflection of the wire. The integration circuit converts the digital pulses to a proportional analog output.

The circuit of FIG. 3 proportions current to the wire 21 in the following manner. Consider the wire 21 cutting normally at a baseline temperature set by potentiometer 32. When an error occurs, the wire 21 is deflected to contact the conductive annulus 22 which causes the LED 23 to light at a level corresponding to the baseline current delivered to the wire 21. Light from the LED 23 illuminates the photoconductor 24 which increases current to the wire 21 which causes the LED 23 to light still more brightly. The brighter LED 23 causes the photoconductor 24 to increase current yet further which again brightens the LED, etc., etc. So the cycle continues until the error is corrected by the ever-increasing temperature of the wire 21. Current to the wire 21, in this instance, therefore is increased in proportion to the length of time that an error persists.

Of course, the LED-photocell current cycle occurs very fast, and in order to avoid artifacts in the polyfoam caused by current overshoot and excessive heating, it is desirable to alter the response speed of the circuitry. Accordingly, the capacitor 27 may be included to slow the response of the LED 23, because the rise time of the LED 23 brightness is determined by the charge time-constant of the capacitor 27. The capacitors 35 and 37 serve a similar function except that they control the time constant of the photoconductor circuit. Likewise, the response of this error-correcting circuit may be altered by the selected responsiveness of the photoconductor 24 itself. A cadmium sulfide photocell will have a slower response time than a cadmium selenide cell, for example.

Altered response time also serves the very important function of integrating successive closely-occurring errors. A higher average current will be delivered to the wire 21 with each closely-spaced error in the train, because a new error cycle will begin before the previous error cycle has ended. The initial brightness of the LED 23 is therefore higher and rapidly occurring errors will then automatically be corrected more rapidly. A complex cut in the polyfoam may quickly produce a large number of successive errors (wire deflections) which must likewise be corrected quickly in order to produce a finely-detailed accurate cut which preserves full detail. The higher average current made possible by the integrating function of altered response time will enable the errors to be corrected as quickly as they are produced. The circuit memory (integration) of the previous error cycle enables the cutter to keep pace with the operator without producing artifacts, because abrupt changes in current which would otherwise produce artifacts are automatically produced only when necessary and appropriate.

Using this proportional deflection correction method the operator is able to produce polyfoam blocks of very great accuracy very quickly. It is therefore important to develop operator accuracy in the tracing process, because details that were formerly lost now are captured with complete fidelity. Accordingly, it is helpful to provide a signal, for example, a human-recognizable signal such as an audio signal from a piezo-electric alarm 38, to signal the operator that the cutter correction system is at work. The operator is then alerted to be mindful of the need for accurate tracing in very detailed areas or when moving quickly. It is also helpful to add a calibration/test switch as at 39. A and A' show where the system used in FIG. 6 can be connected to this triac system of FIG. 3.

A hot wire cutting system of the invention comprises a heating wire adapted to be supported under tension at its opposite ends in a position for the wire to be engaged by material being cut. A force applied by uncut material against the wire displaces the wire from a normal position. The system has power circuit means for supplying heating current to the wire, the power circuit means being adapted to be connected to a source of electrical power including switch means actuatable between "on" and "off" conditions for respectively increasing and decreasing the heating current supplied to the wire. The system also includes sensing means responsive to the deflection of the wire from the normal position which produce an error signal representative of the deflection, and control circuit means for actuating the switch means to the "on" condition in response to the error signal.

The control circuit means may include means for establishing a threshold voltage required to control the switch to its "on" condition, and the control circuit means may further include integrating means for accumulating charges of the error signal so as to maintain the threshold voltage for a predetermined time after the error signal has ceased, whereby the "on" time of the switch is maintained throughout a series of rapidly occurring deflections of the wire from its normal position.

Figure 4:
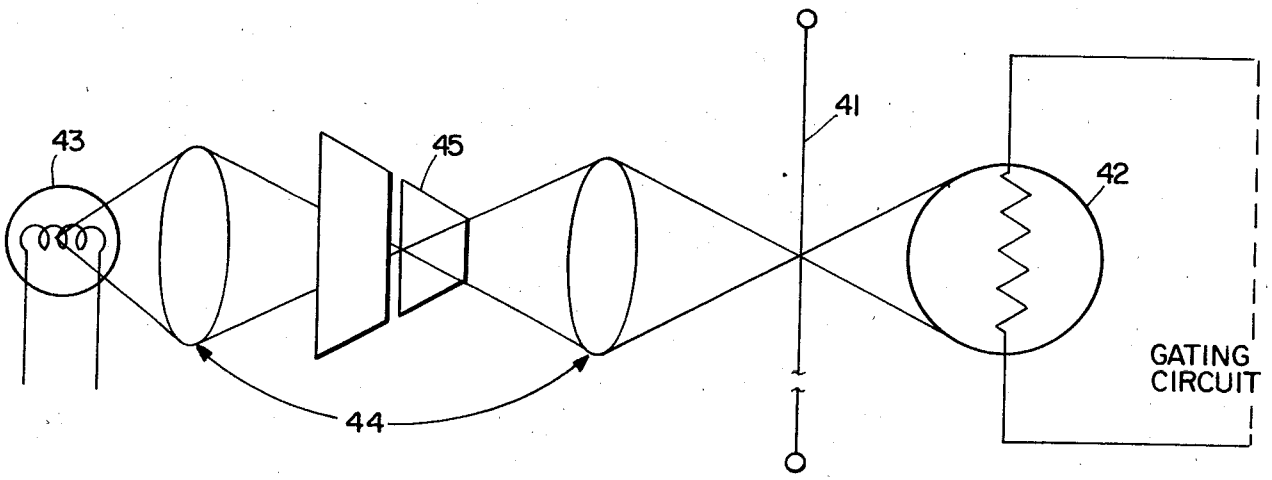
FIG. 4 shows an optical system for detection of deflection of the hot-wire cutter.

A wide variety of sensing systems may be used with this invention. FIG. 4 illustrates an optical detection system which produces an analog output. Here the cutter 41 is shown in the optical path between lamp 43 and photoconductor 42. When the cutter wire 41 is deflected, an exactly proportional amount of light is passed on to the photoconductor 42 which then interfaces with a gating circuit such as that associated with the triac in FIG. 3. The current is then increased to cutter wire 41 in precise instantaneous proportion to the need. The cutter wire 41 then returns to normal position blocking the optical path from lamp 43 lenses 44 and slit 45 which confines the light beam to the area of the wire 41, when the wire 41 is undeflected. In this circuit, then, deflection increases light, which increases current, which increases temperature, and cancels the deflection.

The sensing means may include a light beam source disposed on one side of the wire, and also slit and lens means for focusing a slit of the beam onto the normal position of the wire wherein the slit extends lengthwise of the normally positioned wire and a photocell disposed in the beam path on the other side of the normal position of the wire intercepting the beam slit and deflection of the wire from its normal position clears the path of the beam slit to the photocell, whereby the photocell produces an error signal in an output thereof in response to deflection.

Figure 5:
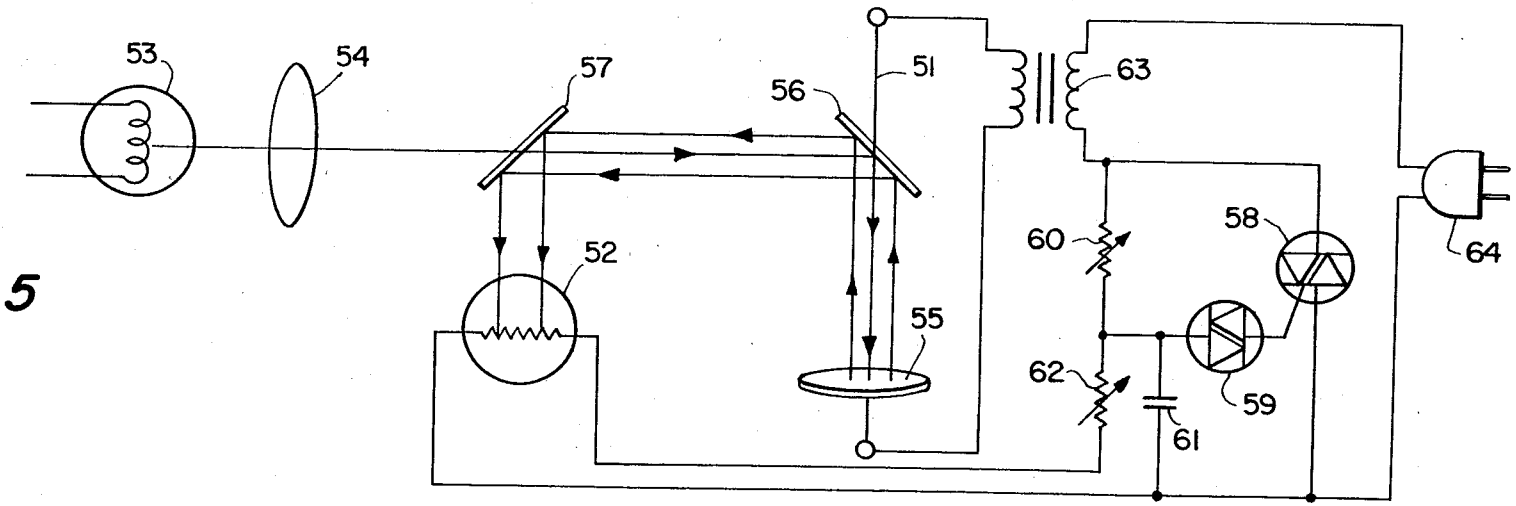
FIG. 5 shows another optical system for detection of deflection of the hot-wire cutter.

By contrast, the circuit of FIG. 5 illustrates another variation, where a decrease in light increases temperature, and the novel geometry of the circuit components is very versatile. Here the hot wire cutter 51 is shown with two mirrors, the plane of the upper mirror 56 at 45 degrees to the axis of cutter 51, and the plane of the lower mirror 55 at 90 degrees to the axis of cutter 51. Cutter 51, as explained, is taken to mean any part of the cutter mechanism liable to deflection. Both mirrors 55 and 56 could, for example, be located below the level of the polyfoam block. In operation, mirrors 55 and 56 must remain in alignment, otherwise the light beam from light source 53 through lens 54 and retroreflected onto photoconductor 52 will fall away from photoconductor 52 and increase current to cutter 51. The optical path includes a 45 degree beam splitter 57, so that the light beam retains the same path in both directions to and from mirrors 55 and 56. The electrical circuitry operates in reverse to FIG. 4. Light falling on photoconductor 52 through sensitivity control 62 bypasses current to trigger diode 59. When the photoconductor 52 is dark, current through baseline range control 60 fires the diac 59—triac 58 via time capacitor 61, which in turn increases current to transformer 63 fed by current source 64. The output of transformer 63 increases the current to cutter 51, the deflection is cancelled, mirrors 55 and 56 are realigned, photoconductor 52 is illuminated, and the circuit is cut off ready for another cycle. Of course, a great variety of applicable optical detection systems, both light and dark activated, are readily available to those skilled in the art.

In system of this type, the sensing means including a mirror system comprised of first and second mirrors connected to the wire at spaced intervals for movement therewith, has the first and second mirrors disposed at 45 degrees and 90 degrees respectively to the length of the wire, and has, as means for projecting a beam of light onto the first mirror, a reflective beam splitter disposed in the beam path between the beam source and the first mirror. A photocell is disposed in the path of the beam reflected by the beam splitter, and a beam of light from the source normally passes through the beam splitter to the first mirror, thence to the second mirror and back to the first mirror and back to the beam splitter and thence to the photocell. Deflection of the wire from its normal position displaces the beam from its normal path and reduces the light falling onto the photocell and thereby produces an output thereof.

Figure 6:
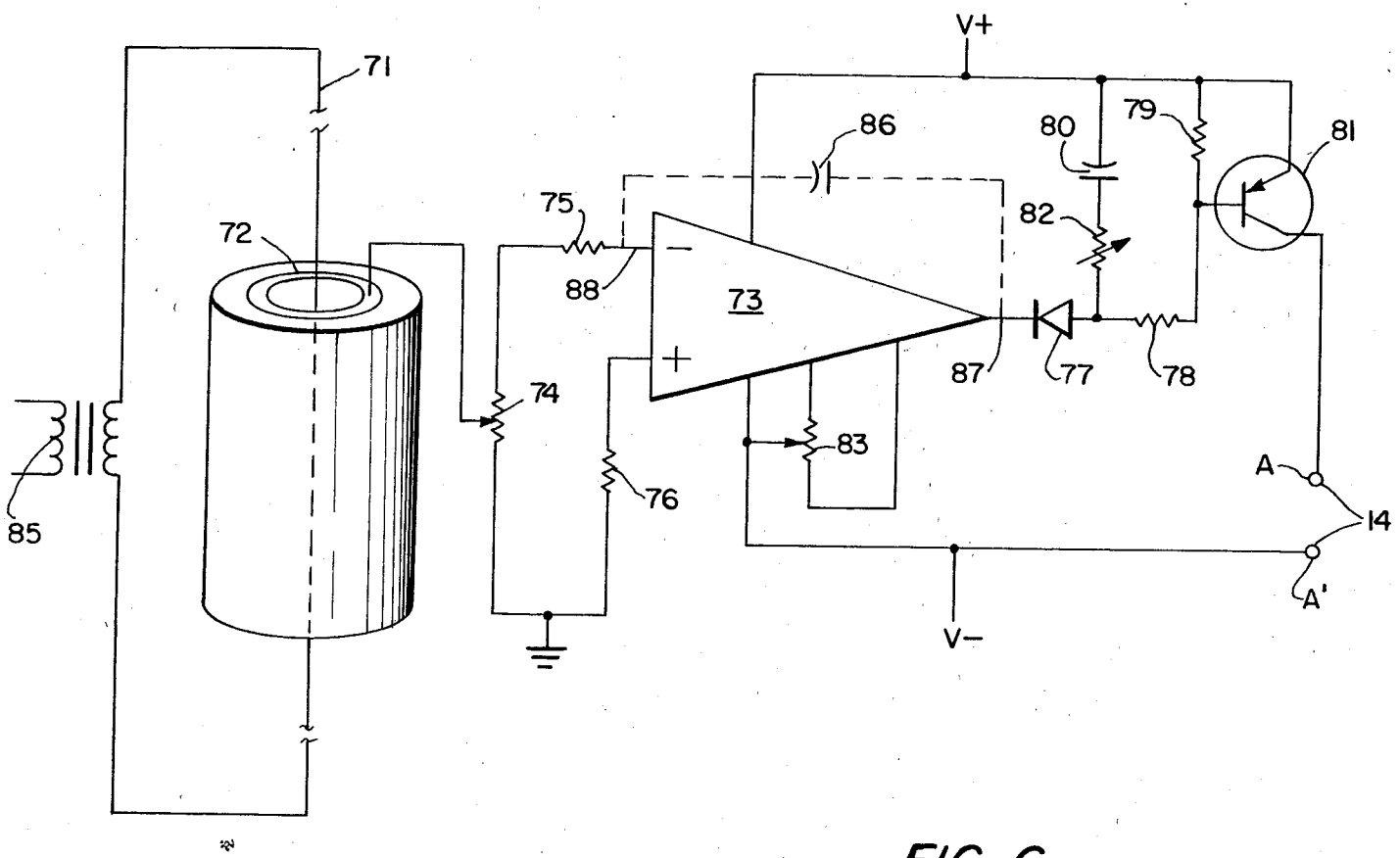
FIG. 6 shows an electro-magnetic method of sensing deflection of the hot-wire cutter.

FIG. 6 illustrates another alternative method of sensing, where deflection of the cutter causes changes in the electromagnetic field surrounding the cutter. In FIG. 6, cutter 71 is shown surrounded by a conductive annulus or tube 72, the hollow of which is spaced from cutter 71. The air-space between annulus 72 and cutter 71 is the dielectric space. When the cutter is deflected, annulus 72 detects the error signal by capacitive coupling and sends the detected error signal onto the operational amplifier 73 which processes the signal for application to the gating transistor 81, the output of which may be appropriately interfaced to a triac circuit at A and A' such as that shown in FIG. 3, for application to transformer 85, for example. Alternatively, A and A' can be connected and the circuit run on direct current, though the aforementioned alternating current system is preferred. The differential input of operational amplifier 73 (or comparator) may be finely adjusted by input resistors 75 and 76, so that any deviation from the null threshold set by potentiometer 74 is instantly detected and greatly amplified by operational amplifier 73 for application to the rectifying diode 77 which triggers the gating transistor 81 through the resistive divider 78 and 79. Capacitor 80 through potentiometer 82 controls the time-constant integration while potentiometer 83 controls the DC offset voltage to prevent unstable triggering. Amplifier feedback integration may also be used, as with the addition of capacitor 86 between operational amplifier output 87 and the inverting input 88. This circuit is extremely sensitive to changes in wire position and by careful adjustment of the input and output parameters may be used in either digital or analog mode. In this type of system the sensing means comprises a differential amplifier and capacitative coupling means between the amplifier and the wire, the coupling means comprising an annular member surrounding and normally spaced from the wire, the annular member and wire comprising plates of the capacitor and the air there between constitutes a dielectric. The displacement of the wire from a normal position increases the capacitative coupling and produces in an output of the amplifier an error signal which is the analogue of the wire displacement.

It will be apparent to those skilled in the art that a wide variety of circuits and sensing schemes can be used with this invention, all with the object of sensing wire deflection and automatically correcting the deflection. While the circuits illustrated are representative, they are only an indication of the variety of suitable circuits which may be used. All of the circuits shown, for example, are used for omnidirectional sensing, that is they sense deflection in any direction, but it is perfectly possible to orient the sensor(s) in such manner that deflection in only one or more selected directions is detected.

If this is done, then the cutter will cut only straight lines (or shapes) automatically, which may be used in some rapid-production instance. The basic scheme is to detect deflection, which is a product of strain upon the wire at right angles to its axis. Certainly the strain can be detected directly, as with a strain gauge, but the cutter wire is liable to strain from sources other than cutting, such as changes in length with aging of the wire or changes in temperature. Therefore, if a strain gauge is used, it must be physically situated so that it does not detect strain from tension upon the wire but responds only to strain from deflection. Placement parallel to the wire is most suitable, but great care must be taken to assure that the strain gauge is insensitive to thermal variations.

Accurate cutting thus assured, it is desirable to cut as fine a line as possible in order to preserve as many details as possible. To accomplish this, it is desirable to use as fine a wire as is compatible with the mechanical forces involved, and to heat the wire electrically to the lowest temperature at which it will cut effectively. It is therefore important to have the wire cut efficiently. It has been found that the wire will cut more efficiently if it is kept in fine vibratory motion while cutting.

Fine vibratory motion enhances cutting efficiency, because the compressive forces exerted upon the polyfoam by the vibrating motion at once both mechanically cuts the foam block and improves thermal transfer. This allows a lower wire temperature to be used and consequently a finer line is cut. No problems are caused even when gross movement of the wire cutter is stilled, as when the operator pauses.

The wire may be set in fine vibratory motion by many means such as side or end (transverse or longitudinal) transducers driven by a power oscillator. In practice, however, such complexity is not required and a much simpler arrangement is possible. If the wire is heated with an alternating current, then it is simply necessary to place part of the wire in a magnetic field, such as in the gap of a permanent magnet so that opposite pole portions of the magnet are disposed on opposite sides of the wire. The wire then becomes its own transducer and will vibrate under the influence of the field as it is energized by the alternating current, and the complex damped waves enhance the cutting. It is desirable to adjustably spring-load the wire in order to "tune" the wire for best eficiency. Since the motion of the wire is the product of the electrical current and the magnetic field, the amplitude is automatically self-adjusting when used with the wire deflection sensor because the current varies in response to the demand. Furthermore, the cutting temperature can be lower enabling the wire to last longer before breaking due to the proportioned current, the vibratory motion, and the absence of bursts of current which means that the wire does not overheat.

Figure 7:
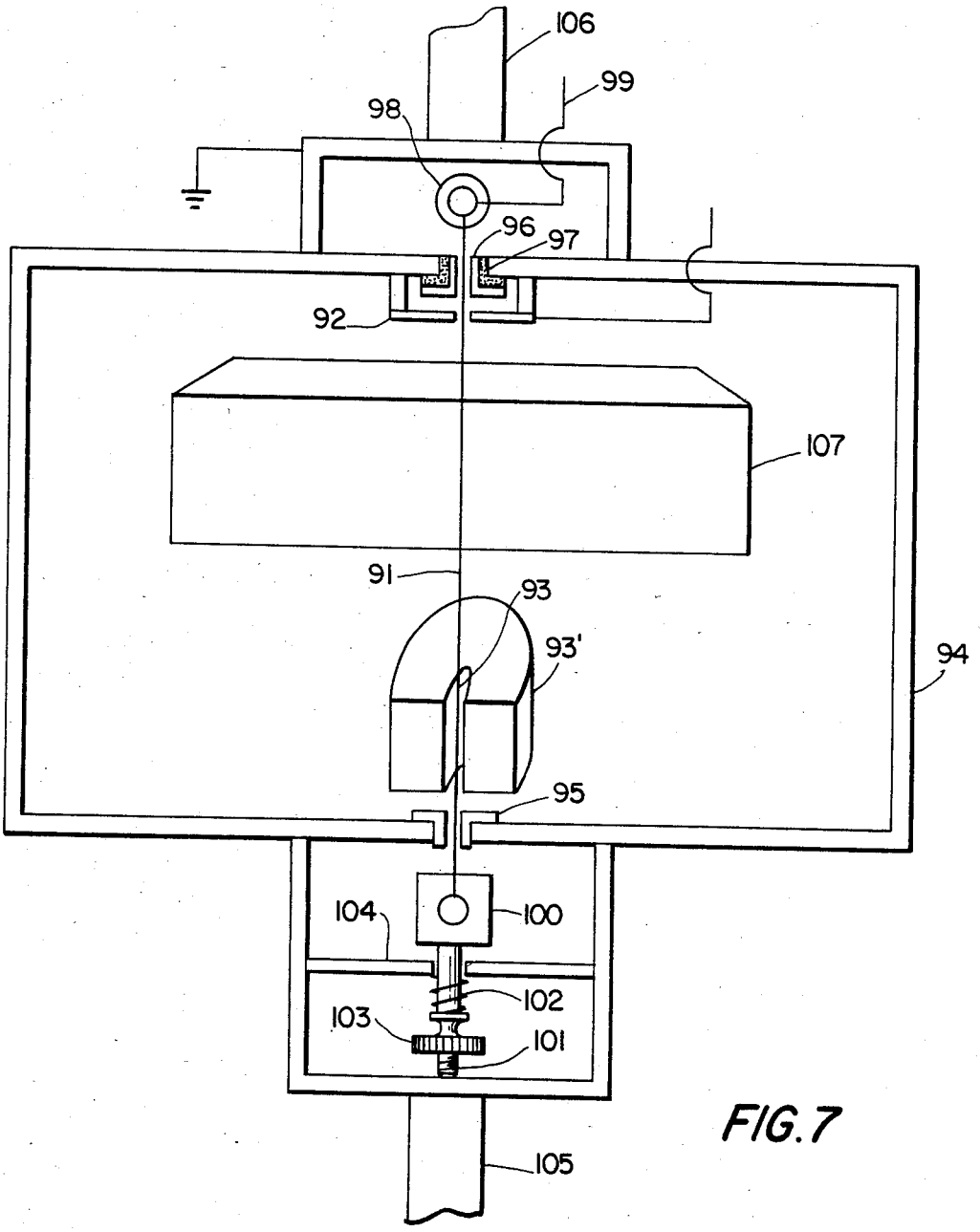
FIG. 7 shows a circuit having the hot-wire cutter in a magnetic field.

The general arrangement of the parts, including the magnet, is illustrated at FIG. 7, where the cutter wire 91 and polyfoam block 107 are shown suspended in the frame 94 of a cutter mechanism such as that used in a segment of a long wire cable or rigid rod between the pivot (phantom radiation source) 98 and X-ray tracing. The wire 91 is shown with the deflection sensor 92 such as that shown in FIG. 3, and the wire 91 fed from a current source 99 via insulated terminal 98 and grounded to the frame 94 at the other terminal 100 which is spring-loaded at 102 by threaded rod 101 and adjustment nut 103 working against stop 104. The wire 91 is threaded between two precision bearings, the lower bearing 95 is grounded and the upper bearing 96 is insulated by insulator 97. The gap 93 of magnet 93' (shown disproportionately large for clarity) is proximal to the wire. The upper rod 106 (or wire cable) goes on to the pivot and the lower rod 105 (or wire cable) extends to the X-ray tracing.

As the now extremely accurate pattern emerges in the polyfoam block, it is desirable to check the work against the X-ray pattern. This is conventionally accomplished by arduously removing or displacing the pivot and cutter and placing a light at the pivot point. The light then casts a shadow of the polyfoam pattern on the X-ray and if additional work or cutting is required then the entire apparatus must be set back in place, usually through some complex and inaccurate mechanical contrivance. An improved arrangement for this part of the apparatus is illustrated at FIGS. 8 and 9 wherein it is not necessary to remove the cutter or the pivot in order to place the light at the virtual pivot point.

Figure 8:
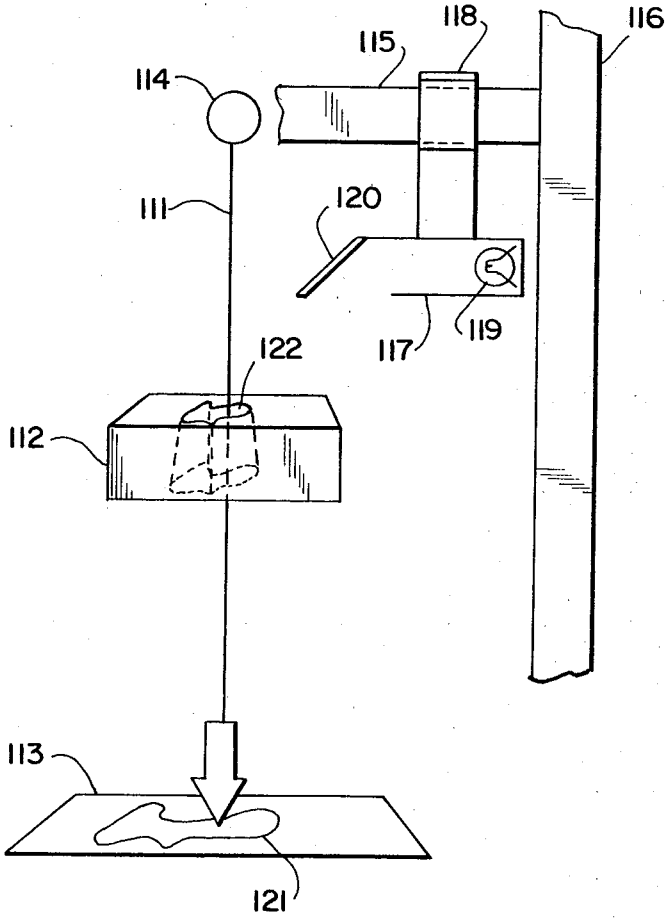

FIG. 8 shows the pivot 114 with the cutter wire 111 extending through the polyfoam block 112 to the pattern 121 on the X-ray film 113, showing the cutting pattern 122 of the shape which has been cut from block 112. Upright arm 116 supports arm 115 which bears pivot 114. On arm 115 is a slider 118 which supports a projector 117 including virtual point-source lamp 119 and mirror 120 at 45 degrees to the axis of projector 117.

Figure 9:
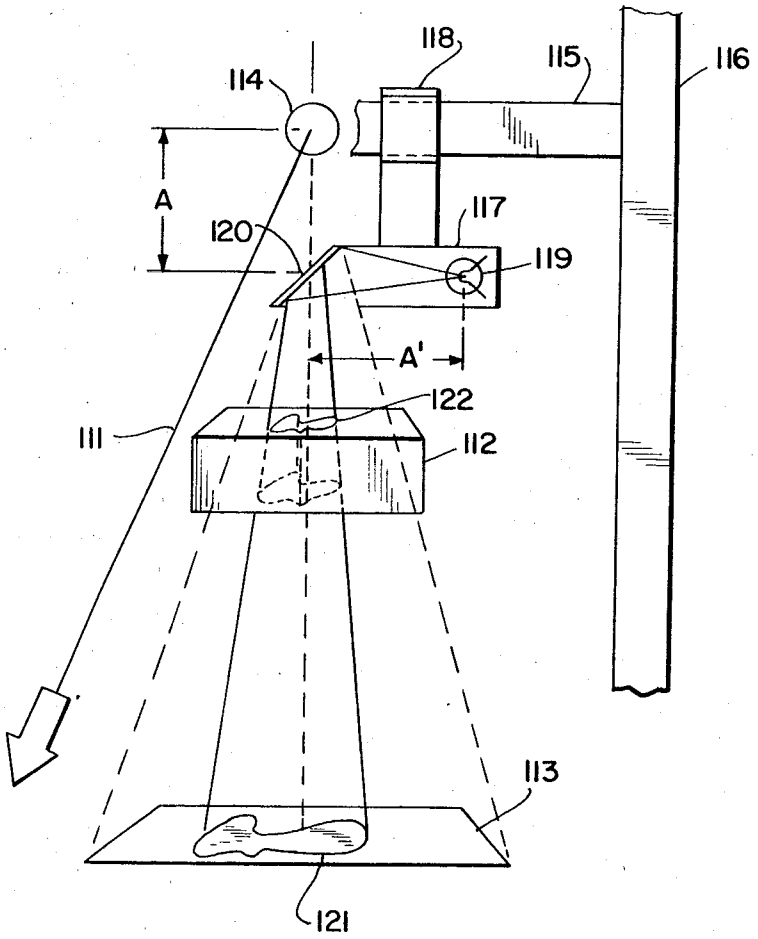
FIGS. 8 and 9 show a system for checking the accuracy of a cut polyfoam block.

When it is desired to check the pattern 122 in the polyfoam 112, FIG. 9 shows that cutter 111 swings aside to allow projector 117 to move into place. Mirror 120 is then in the original path of cutter 111, although vertically displaced from pivot 114 by distance (A), which is precisely the same distance (A') of the lamp 119 from mirror 120. This folded path exactly simulates the path length of a light beam if the light source were at the location of pivot 114, but without the inconvenience, inaccuracy, and complexity of cumbersome mechanical contrivance. Of course, any type of virtual point-source is suitable for the projector so long as the "point" is at the correct distance.

The optical path in this arrangement then becomes the same as if the light source were at the phantom radiation source and a shadow 121 of correct perspective is cast upon the X-ray film 113 without removing the cutter wire or the pivot.

The system described represents an optical system for comparing the profile of the periphery of a cavity cut in a block of polyfoam or like material by a hot wire with the shape of an X-ray pattern from which the cavity was traced. The block of material is supported above the X-ray pattern, the hot wire is supported at a pivotal axis above the block, and the longitudinal axis of the wire extends along a radius which extends from the pivotal axis through the block substantially to the X-ray pattern and moves through a normal range of radial positions in cutting the cavity. The system includes a vertical support disposed laterally from the normal range of positions of the wire. An arm having a fixed end is mounted on the vertical support, and the arm has a free end extending towards the normal range of positions of the wire. An optical projecting means is mounted on the arm, the means comprising a virtual point source of light disposed relatively away from the normal range of positions of the wire and a 45° mirror disposed relatively towards the normal range of positions of the wire and spaced from the point source by a certain predetermined distance. The optical projecting means is movable along the length of the arm whereby, when the wire is removed, the mirror is disposed in the normal range of positions of the wire and is spaced from the pivotal axis of the wire by a certain predetermined distance, so as to project a beam of light towards the X-ray pattern and through the cavity, so that portions of the block surrounding the cavity cast a shadow onto the X-ray pattern corresponding to the periphery of the cavity cut from the block. After thus confirming that the polyfoam block has been correctly cut, the alloy blocks can be poured.

Variations and modifications of this invention can be effected within the spirit and scope of the invention as described above and as defined in the appended claims.

I claim:

1. A hot wire cutting stystem comprising, a heating wire adapted to be supported under tension at opposite end portions in a position for said wire to be engaged by material being cut, wherein a force applied by uncut material against the wire displaces said wire from a normal position, power circuit means for supplying heating current to said wire, said power circuit means being adapted to be connected to a source of electrical power and including control means for respectively increasing and decreasing the heating current supplied to the wire, sensing means responsive to the deflection of said wire from said normal position for producing an error signal representative of the estent of said deflection, said control circuit means being responsive to said error signal for respectively increasing and decreasing the heating current supplied to said wire representative of extent of said deflection.

2. A hot wire cutting system as claimed in claim 1, said sensing means comprising a light beam source disposed on one side of the wire and including slit and lens means for focusing a slit of the beam onto the normal position of the wire wherein the slit extends lengthwise of the normally positioned wire and a photocell disposed in the beam path on the other side of the normal position of the wire intercepting the beam slit and deflection of the wire from its normal position clears the path of the beam slit to the photocell, whereby said photocell produces the error signal.

3. A hot wire cutting system as claimed in claim 1, said sensing means including a mirror system comprised of first and second mirrors connected to the wire at spaced intervals for movement therewith, said first and second mirrors being disposed at 45 degrees and 90 degrees respectively to the length of the wire, means for projecting a beam of light onto the first mirror, a reflective beam splitter disposed in the beam path between the beam source and the first mirror, and a photocell disposed in the path of the beam reflected by the beam splitter, wherein a beam of light from the source normally passes through the beam splitter to the first mirror, thence to the second mirror and back to the first mirror and back to the beam splitter and thence to the photocell, and deflection of the wire from its normal position displaces the beam from its normal path and reduces the light falling onto the photocell and thereby produces the error signal.

4. A hot wire cutting system as claimed in claim 1, said sensing means comprising, a capacity-responsive differential amplifier and capacitative coupling means between the amplifier and the wire, said coupling means comprising an annular member surrounding and normally spaced from the wire, said annular member and wire comprising plates of the capacitor and the air there between constitutes a dielectric, and wherein displacement of the wire from a normal position increases the capacitative coupling and produces in an output of the amplifier an error signal which is the analogue of the wire displacement.

5. A hot wire cutting system as claimed in claim 1, and means responsive to said deflection for producing an audible signal denoting said deflection.

6. A hot wire cutting system comprising, a heating wire adapted to be supported under tension at opposite end portions in a position for said wire to be engaged by material being cut, wherein a force applied by uncut material against the wire displaces said wire from a normal position, power circuit means for supplying heating current to said wire, said power circuit means adapted to be connected to a source of electrical power including switch means actuatable between "on" and "off" conditions for respectively increasing and decreasing the heating current supplied to the wire, sensing means responsive to the deflection of said wire from said normal position for producing an error signal representative of said deflection, and control circuit means for actuating said switch means to said "on" condition in response to said error signal, said control circuit means including means for establishing a threshold voltage required to control said switch to its "on" condition, said control circuit means further including integrating means for accumulating charges of said error signal so as to maintain said threshold voltage for a predetermined time after said error signal has ceased, whereby the "on" time of said switch is maintained throughout a series of rapidly occurring deflections of said wire from its normal position.

7. A hot wire cutting system as claimed in claim 6 wherein said integrating means for accumulating charges of said error signal delivers increased current to the wire in response to a succession of rapidly occurring deflections of said wire from its normal position.

8. A hot wire cutting system as claimed in claim 6 wherein said integrating means for accumulating charges of said error signal delivers an amount of current to the wire which is increased in proportion to the length of time that an error signal representative of a deflection of said wire persists.

9. A hot wire cutting system comprising, a heating wire, means for supporting opposite end portions of the wire in a normal position for said wire to be engaged by the material to be cut wherein force supplied by uncut material against the wire deflects the wire from the normal position, a source of alternating current including a power supply circuit having opposite sides for energizing the wire, sensing means responsive to the displacement of said wire from said normal position for producing a signal representative of the extent of said deflection, means responsive to said signal for connecting the wire across the opposite sides of said power supply circuit and thereby energizing the wire, and means for creating a magnetic field through which said heating wire passes, whereby said wire constitutes a transducer and vibrates when energized by said alternating current.

* * * * *

UNITED STATES PATENT AND TRADEMARK OFFICE

CERTIFICATE OF CORRECTION

PATENT NO. : 4,601,224

DATED : July 22, 1986

INVENTOR(S) : William T. Clark, III

It is certified that error appears in the above-identified patent and that said Letters Patent is hereby corrected as shown below:

In Claim 1, col. 9, line 29, change "estent" to -- extent --; line 35, before the word "extent" insert -- the --.

Signed and Sealed this

Eighteenth Day of August, 1987

*Attest:*

DONALD J. QUIGG

*Attesting Officer*

*Commissioner of Patents and Trademarks*